US005389119A

United States Patent [19]

Ferronato et al.

[11] Patent Number: 5,389,119

[45] Date of Patent: Feb. 14, 1995

[54] ABRASIVE MEMBER COMPRISING A NONWOVEN FABRIC AND A METHOD FOR MAKING SAME

[75] Inventors: Sandro G. G. Ferronato, Elburg; Natalino Ferronato, Ennerbaden, both of Netherlands

[73] Assignee: KGS Diamind Holding B.V., Elburg, Netherlands

[21] Appl. No.: 121,198

[22] Filed: Sep. 15, 1993

[30] Foreign Application Priority Data

Apr. 19, 1993 [NL] Netherlands ..... 9300661

[51] Int. Cl.[6] ..... B24B 1/00

[52] U.S. Cl. ..... 51/296; 51/293; 51/295; 51/308; 51/309

[58] Field of Search ..... 51/293, 295, 296, 298, 51/308, 309

[56] References Cited

U.S. PATENT DOCUMENTS

| | | | |
|---|---|---|---|
| 3,607,159 | 9/1971 | Haywood | 51/296 |
| 4,162,344 | 7/1979 | Renes | 428/212 |
| 4,543,106 | 9/1985 | Parekh | 51/295 |
| 4,581,287 | 4/1986 | Smith et al. | 51/296 |
| 4,966,609 | 10/1990 | Callinau et al. | 51/295 |
| 5,096,464 | 3/1992 | Amamoto | 51/293 |
| 5,213,591 | 5/1993 | Celikkaye et al. | 51/293 |

FOREIGN PATENT DOCUMENTS

| | | |
|---|---|---|
| 013486 | 7/1980 | European Pat. Off. . |
| 0263785 | 4/1988 | European Pat. Off. . |
| 0280657 | 8/1988 | European Pat. Off. . |
| 0510823 | 10/1992 | European Pat. Off. . |
| 8447 | 9/1840 | United Kingdom . |
| 1375571 | 11/1974 | United Kingdom . |
| 2223966 | 10/1991 | United Kingdom . |

OTHER PUBLICATIONS

Patent Abstracts of Japan, vol. 13, No. 420 (M-872)(3768) 19 Sep. 1989 & JP-A-0159179 (H. Kawai et al.) 22 Jun. 1989.

Soviet Inventions Illustrated, Section Ch, Week 7913, 10 May 1979 & SU-A-605719, 20 Apr. 1978.

*Primary Examiner*—Mark L. Bell
*Assistant Examiner*—Willie J. Thompson
*Attorney, Agent, or Firm*—Watson, Cole, Grindle & Watson

[57] ABSTRACT

An abrasive member comprising an electrically conductive or non-conductive open, porous layer comprising a nonwoven fabric supporting a metal structure which carries an abrasive material. The porous layer, at a side thereof not containing abrasive material, may be provided with a backing layer having heat conductive properties. Further, the porous layer may consist of two or more layers stacked together, at least one of these layers being a nonwoven fabric. Such an abrasive member is excellently suitable for heavy duty dry-grinding operations, such as the grinding of granite. The abrasive metal structure can be applied onto and through the porous layer by an electroplating or electro-deposition process.

25 Claims, 1 Drawing Sheet

ABRASIVE MEMBER COMPRISING A NONWOVEN FABRIC AND A METHOD FOR MAKING SAME

BACKGROUND OF THE INVENTION

The invention relates to abrasive members comprising an electrically conductive or non-conductive open, porous layer supporting a metal structure which carries an abrasive material. In a method for making such an abrasive member, the metal structure is formed by electroplating or electrodeposition on the porous layer in the presence of abrasive material, such that the metal structure penetrates at least partially through the holes or pores of the porous layer.

Abrasive members of this type are typically used for the purpose of removing stock and in the fine grinding or smoothing of hard materials such as glass, hard plastics, metal and other hard materials such as stone. Dependent on a particular operation and/or the shape and curvature of an object to be treated, the abrasive member may take the form of a flexible, semiflexible or rigid body such as a disc, sheet, handpad, block, tape or endless belt etc.

The metal structure and abrasive material are usually applied to the porous layer by an electroplating or electro-deposition process. Electroplating or electro-deposition of a metallic coating on an electrode is a technology well-known in the art, such as for example described in GB-A-8,447 (Elkington et al. 1840). Electroplating is essentially a surface treatment. The material to be treated is made the cathode in an electroplating metal containing electrolyte solution or bath. By connecting a DC power source with its positive pole to an anode in the bath and its negative pole to the cathode, the metal is reduced from the bath and deposited onto the cathode.

GB-A-1,375,571 (Prowse) discloses a method of making an abrasive member of the type mentioned above, wherein the porous layer supporting the metal structure is a metallic or non-metallic flexible, semiflexible or rigid layer of mesh material or a sheet metal object, having a solid or perforated surface.

GB-B-2,223,966 (Diaforce Ltd.) relates to the making of an abrasive member wherein the porous layer is an electrically conductive flexible mesh material.

EP-B-0,013,486 (Interface Developments Ltd.) discloses a method of making a flexible abrasive member by electrodeposition of an abrasive metal structure onto a porous layer of electrically non-conductive mesh material such as woven fibre cloth or fabric.

Woven fabrics are made by interlacing and looping or knotting together yarns or fibres in a highly regular repetitive design in any of many well-known ways to form a mesh pattern or gauze. The strength of the fabric is derived from friction between the fibres.

Abrasive members of this type have to be used under any circumstance with a coolant such as water or soluble oils, because otherwise the flexible abrasive member will be destroyed in a very short period of time due to the heat developed. It is of utmost importance not to use a coolant which would affect the abrasive member or the object to be treated. Further, it is vital that grinding fluids be kept clean. A dirty coolant will recirculate metal and abrasive chips, thus affecting the finish desired. Accordingly, grinding machines are required which have facilities for wet-grinding, such as a coolant supply tank, recirculating mechanisms, cleaning or filtering means and a settling tank for sludge. In order to promote the efficiency of the filtering and recirculation the sludge has to be removed frequently.

SUMMARY OF THE INVENTION

The object of the invention is to provide an abrasive member of the type mentioned above, which can be used in grinding operations on hard materials such as glass, marble, granite and others without having to expressly use a coolant, i.e. a wet-grinding machine.

According to the invention, this object is achieved in that the porous layer, which supports the metal structure, comprises an electrically conductive or non-conductive nonwoven fabric. Nonwoven fabrics are porous, open textile-like materials, which are composed of fibres and are manufactured by processes other than spinning, weaving, knitting or knotting. The total composition may consists of one type of fibres or a mixture of fibres of different material, dimensions or type. The individual fibres are arranged randomly. The tensile and stress-strain properties are, amongst others, imparted to the fabric by entanglement of the fibres. This creates a fibre-to-fibre friction which is direction or fibre orientation independent and makes that the fabric is very difficult to tear into pieces.

Due to its high resistance to tearing, the abrasive member according to the invention is suitable for use in dry-grinding for which relatively simple an less expensive grinding machines can be used and without any danger of an adverse effect of coolant on the subject to be treated or the abrasive member itself. It has been found that the abrasive member according to the invention is particularly suitable for use in grinding operations wherein the abrasive member is moved in a thorough random manner across the surface of an object to be treated.

On the contrary, once ripped, regularly woven mesh-type fabrics can be easily torn into pieces by subjecting the mesh to a pulling force in a specific direction or orientation. It is because of this reason that abrasive members having an abrasive structure supporting layer of (regular) mesh material have to be protected from ripping, to which end the use of a coolant is necessary. However, even with coolant such abrasive members are not suitable for heavy duty applications, for example the grinding of granite.

The texture or feel of nonwoven fabrics may range from soft to harsh. In a preferred embodiment of the invention, for producing a flexible abrasive member for fine grinding operations, a nonwoven fleece-type layer is used.

In order to promote an evenly distribution of the heat developed during the grinding process, such to avoid locally overheating of the nonwoven porous supporting layer and the object to be treated, in a further embodiment of the invention a porous layer having desirable heat conductive properties is used.

For reinforcement purposes, and to remove the heat developed, in a yet further embodiment of the invention, the porous layer is at a side thereof not containing abrasive material provided with a backing layer having suitable heat conductive properties. With such a backing layer the mechanical properties of the abrasive member can be controlled, e.g. to produce a highly flexible, semiflexible or rigid abrasive member for a particular field of application, for example.

The backing layer itself may be of a material having suitable heat conductive properties, such as copper, or heat conductive material may be integrated in the backing layer, for example in the form of copper powder, shredded copper or copper strings embedded in a layer of synthetic resin or vulcanised rubber material. A heat conductive material may also be coated on the porous layer or the backing layer, on one or both surfaces thereof. A coating of graphite is applicable to many materials including rubber, plastics or synthetic resins, for example in case of nonwoven support layers composed of polypropylene, polyester or PTFE-Kevlar.

It has been found that the irregular spacing and dimensions of the pores in the nonwoven fabric, different from regularly woven mesh-type fabrics, do not constitute a barrier in the electro-deposition or electroplating of the metal structure which contains the abrasive material.

On the contrary, two or even more layers of nonwoven fabric can be stacked together without special attention to their mutual positioning or orientation. Due to the random spacing an dimensions of the pores of the individual layers, the pores of the stack are again randomly distributed over the surface thereof and having overall dimensions sufficiently wide for deposition i.e. penetration of the metal structure onto and through the porous supporting stack. It will be understood that such stacked layers have an increased mechanical strength, in particular against tearing, providing an abrasive member for heavy duty dry-grinding operations.

In stacking several layers of mesh material, due to their regular structure, it must be observed that the meshes are positioned such that a sufficiently open structure is maintained, for example in that the meshes of adjacent layers are in alignment or crosswise arranged. However, in such a case the overall strength against tearing is not essentially increased, because of the resulting regular structure of the stack.

However, according to the invention it is, for example, also possible to stack a nonwoven and a woven or mesh-type porous layer to provide a desired optical appearance, for example.

The layers of a stack may be connected to each other, in an embodiment of the invention, by penetration of the metal structure on and through the layers. In another embodiment, the adjacent layers of a stack are additionally adhered to each other by means of an adhesive, preferably a heat conductive glue, combining improved mechanical strength and heat conductive properties. A heat conductive glue can be obtained by embedding in an adhesive heat conductive material, such as copper powder, for example.

The metal structure can be applied as a solid structure onto the porous supporting layer. However, in a preferred embodiment of the invention, the metal structure consists of discrete and spaced apart regions over the surface of the supporting layer, for example abrasive material carrying metal patches or islands. With such a structure, passageways between the plated regions are created for discharging grinding dust or in the case of wet-grinding for discharging the sludge formed by a coolant.

Suitable abrasives are, for example, cubic boron, nitride, silicon and natural or synthetic diamond particles. Nickel plating is preferred from a manufacturing point of view. The abrasive member according to the invention may have any suitable form or shape. In practice flexible, semiflexible or rigid discs, sheets, handpads, blocks, tapes or endless belts are suitable designs.

The invention relates also to a method of making an abrasive member comprising an electrically conductive or non-conductive open, porous layer for supporting a metal structure which carries the abrasive material, this metal structure being electroplated under the addition of abrasive material onto a porous layer composed of nonwoven fabric mounted on an electrically conductive or non-conductive electrode or base, such that the metal penetrates at least partially through the holes or pores of the layer and the abrasive material becomes embedded in the metal, the abrasive member formed being demounted from the base.

In the case of an electrically conductive porous layer, i.e. a nonwoven fabric produced from electrically conductive fibres or an electrically non-conductive fabric coated with an electrically conductive material, such as graphite, to enhance the overall heat conductive properties, the fabric itself can act as the cathode electrode in the electroplating bath. The base may be formed from an electrically non-conductive material or an electrically conductive material which is coated at its external surface with a non-conductive coating or layer. It is also possible to use a base having a polished outer layer, e.g. a polished steel foil, to which the metal to be deposited does not adhere or adheres in a very weak manner. The base acts as a substratum during the deposition of the metal structure onto and into the porous nonwoven fabric.

In the case of a nonwoven fabric having no electrically conductive properties, the base has to act as the cathode in the electroplating process. Accordingly, the base has to have electrically conductive properties, i.e. a base manufactured from metal or a non-conductive material coated with an electrically conductive layer, for example a polished steel foil as mentioned above.

In a further embodiment of the invention, the porous layer over a surface thereof is provided with an electrically non-conductive mask, leaving unmasked regions to form discrete and spaced apart metal regions for carrying the abrasive material.

The mask may be formed by tape or photo resist material, for example. In a preferred embodiment of the method according to the invention, electrically non-conductive lacquer is used to create isolated parts of the nonwoven fabric.

Instead of masking the porous layer, it is also possible to mask the electrically conductive base. During the plating process, the unmasked regions of the base act as local cathodes for the metal and abrasives which are in suspension in the electrolyte bath.

For providing an abrasive member having a stacked porous layer, in an embodiment of the method according to the invention, two or more layers of nonwoven fabric are stretched on top of each other on the base, the top layer or the base being provided with the mask.

After demounting from the electrode or base the porous layer, at a side thereof not containing abrasive material, may be provided with a backing layer of a synthetic resin or vulcanised rubber material, preferably a heat conductive resin or rubber material. A primer material may be coated on the side of the porous layer at which the backing layer has to be applied. This in order to create a very tight bonding of the backing layer to the nonwoven supporting structure.

In a yet further embodiment of the invention, the individual layers are subjected to a gluing process after the metal structure is applied. The glue can be applied from outside the stack and will absorb into and through the separate layers. This results in an abrasive member in which the metal patches are surrounded by the adhesive. The backing layer may be also directly adhered to the porous layer or the stack of porous layers by the gluing process.

The invention will now be described by way of example only and with reference to the accompanying drawings of an embodiment of the invention.

DETAILED DESCRIPTION OF THE EMBODIMENTS

Figure 1:
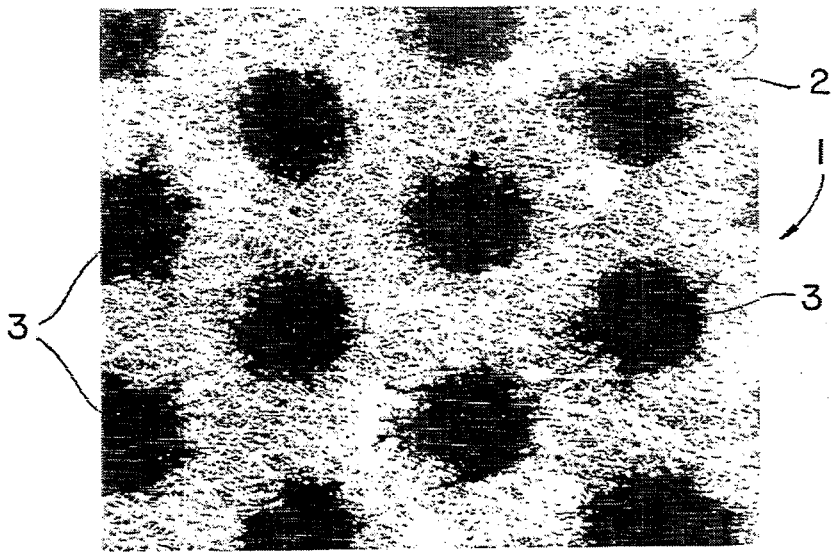
FIG. 1 is a plan view of a portion of an abrasive member according to the invention.

FIG. 1 shows an abrasive member 1 having a porous nonwoven fabric layer or fleece 2 which supports patches 3 of metal having a more or less circular cross-section. The patches 3 carry at their outer surface abrasive material. The randomly arrangement of the fibres and the random distribution of the dimensions of the individual pores are clearly visible in the figure . The nonwoven fabric may be formed from fibres of electrically conductive material or non-conductive material such as polypropylene, polyester or PTFE-Kevlar.

The thickness and length of the fibres and other physical-mechanical parameters defining the ultimate properties of the fabric, such as the inclusion of bonding additives and web structure, may be chosen in view of a particular application. Nonwoven fabrics suitable for the purpose of the invention are commercially available.

Figure 2:
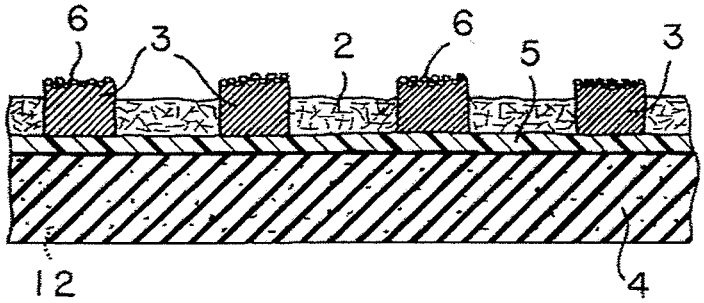
FIG. 2 is a schematic cross-section through a portion of an abrasive member of the type shown in FIG. 1.

In the cross-section of the abrasive member 1 shown in FIG. 2, the nonwoven fabric layer 2 is provided with a backing layer 4 of vulcanised rubber. The backing layer 4 is adhered to the nonwoven porous layer 2 by means of an intermediate layer or primer 5. Heat conductive particles 12 such as copper powder, shredded copper, copper strings or particles of graphite are embedded in the backing layer 4, in order to obtain suitable heat conductive properties for dry-grinding applications of the abrasive member 1. This to avoid as much as possible damaging of the abrasive member 1 and/or the object to be treated, due to locally overheated spots. With this heat conductive material, the heat developed during use is evenly distributed over the surface of the abrasive member and can be exchanged with the grinding machine, i.e. the part thereof to which the abrasive member 1 is mounted.

The backing layer 4 may have any shape required, such as a sheet, block, handpad, a tape or endless belt, disc etc. Instead of rubber, such as to provide a flexible abrasive member, the backing layer 4 may be made up of semiflexible or rigid material, for example thermoplastic or thermosetting synthetic resin.

It can be seen that the metal patches 3 are penetrated through the pores of the nonwoven fabric 2. At the side of the patches turned away from the backing layer 4, abrasive particles 6 are embedded in and adhered to the metal patches 3. Nickel is a preferred plating metal. The abrasive material may be natural or synthetic diamond particles, cubic boron, nitride, silicon or other suitable hard materials, inter alia dependent on a particular application of the abrasive member.

Figure 3:
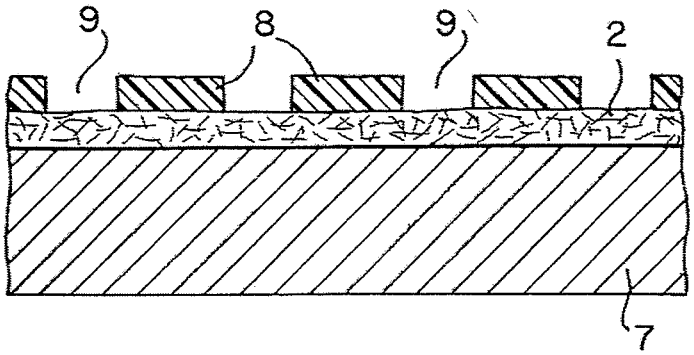
FIG. 3 is a schematic cross-section through a portion of a masked nonwoven fabric layer mounted on a base for electroplating purposes.

In FIG. 3 an electrically non-conductive nonwoven fabric layer 2 is mounted on an electrically conductive base 7. Prior to the plating process, the top layer of the nonwoven fabric 2 is provided with a mask 8 of non-conductive material, such as lacquer, silk, photo resist etc. At the unmasked regions 9 metal 3 and abrasive 6 will be deposited during the subsequent electroplating process. Once the plating has been completed, the layer 2 is demounted from the base 7 and a backing layer 4 may be applied, if applicable.

The plating process is started with an electrolyte solution containing only metal. After a metal structure 3 of a desired thickness has been deposited onto and through the pores of the porous layer 2, abrasive grit is introduced in the bath, such that at the top of the metal structure abrasive material 6 is embedded in the metal. The thickness of the deposited abrasive and size of the grit can be chosen in view of specific requirements, i.e. a specific type of grinding, ranging from coarse to fine, for example.

Figure 4:
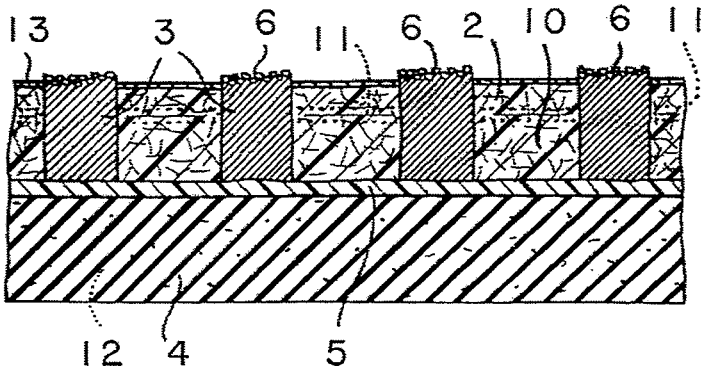
FIG. 4 is a schematic cross-section through a portion of an abrasive member according to the invention, comprising a multilayered nonwoven fabric.

FIG. 4 shows a composition of two layers 2, 10 of nonwoven fabric stacked together. It can be observed that the metal patches 3 are penetrated through the pores of both stacked layers 2, 10. After plating, the layers 2, 10 are additionally adhered to each other by means of heat conductive glue 11 applied from the outside surface of the stack. Due to the absorption properties of the nonwoven layers, the glue penetrates into and through the separate layers 2, 10 in the regions between the metal patches. The multilayered structure is adhered to a backing layer 4 provided with a primer 5.

Instead of stacking layers 2, 10 of nonwoven fabric, layer 2 may be a woven or mesh material, such to provide a desired optical appearance. Further, instead of or in addition to the heat conductive backing layer 4, the outside facing surface of layer 2 may be coated with a layer 13 having heat conductive properties such as a coating of graphite, for example. Layer 2 and, if applicable, layer 10 can be provided with heat conductive properties either, for example by incorporating heat conductive powder material therein. In this application, the term heat conductive properties has to be construed as having a proper thermal conductivity for the purpose of avoiding thermal overheating during normal use.

The invention is not limited to the embodiment disclosed. Instead of circular metal patches 3 as shown, patches of other cross-section or shape may be used, such as a hexagonal cross-section. A metal structure having another shape, for example a solid layer, may be applied as well. In practice, the thickness of the nonwoven fabric layer or fleece will range from approx. 0,1–1 mm and the patches 3 may range in diameter from approx. 1 to 10 mm. The cross-sectional dimensions of the abrasive particles 6 varies essentially from 20 to 600 micron, dependent on a particular grinding operation to be performed. The height of the metal patches 3 measured from the nonwoven layer 2 ranges in practice from 0,2 to 2 mm.

Contrary to the process illustrated in FIG. 3, the mask 8 may be applied to the base 7 before mounting of the porous layer 2, resulting in an abrasive member having a similar structure as obtained by the process illustrated. The base 7 may be formed from conductive material and/or provided with a conductive outer layer, such as a polished steel layer. Besides using a plating process, the metal structure may be applied to the nonwoven fabric by means of other suitable techniques.

We claim:

1. An abrasive member comprising an open, porous layer supporting a metal structure which carries an abrasive material, said porous layer comprising a nonwoven fabric.

2. An abrasive member according to claim 1, wherein the nonwoven fabric is a fleece layer.

3. An abrasive member according to claim 1, wherein the porous layer having heat conductive properties.

4. An abrasive member according to claim 3, wherein heat conductive material is coated onto the porous layer.

5. An abrasive member according to claim 4, wherein the porous layer at a side thereof not containing abrasive material is provided with a backing layer having heat conductive properties.

6. An abrasive member according to claim 5, wherein the backing layer is selected from a resin or vulcanised rubber material comprising heat conductive material.

7. An abrasive member according to claim 6, wherein the heat conductive material is graphite.

8. An abrasive member according to claim 6, wherein the heat conductive material is copper.

9. An abrasive member according to claim 1, wherein the porous layer consists of two or more layers stacked together, at least one of said layers being a nonwoven fabric.

10. An abrasive member according to claim 9, wherein adjacent layers are adhered to each other by an adhesive.

11. An abrasive member according to claim 10, wherein the adhesive is a heat conductive glue.

12. An abrasive member according to claim 1, wherein the nonwoven fabric is composed of a polymer selected from the group of polypropylene, polyester and polytetrafluoroethylene.

13. An abrasive member according to claim 1, wherein the metal structure consists of discrete and spaced apart regions of metal which carries the abrasive material.

14. An abrasive member according to claim 1, wherein the abrasive material comprises diamond particles.

15. An abrasive member according to claim 1, wherein the metal structure comprises nickel.

16. A method of making an abrasive member comprising an open, porous layer for supporting a metal structure which carries an abrasive material, said metal structure being electroplated under the addition of abrasive material onto the porous layer mounted on a base, such that the metal penetrates at least partially through the holes or pores of the layer and the abrasive material becomes embedded in the metal, either one of said porous layer and base having electrically conductive properties, the abrasive member formed being demounted from the base, and wherein said porous layer comprising a nonwoven fabric.

17. A method according to claim 16, wherein the porous layer is of electrically conductive material and over a surface thereof provided with an electrically non-conductive mask, leaving unmasked regions to form discrete and spaced apart metal regions which carry the abrasive material.

18. A method according to claim 17, wherein the mask is formed of electrically non-conductive lacquer.

19. A method according to claim 16, wherein the base is of electrically conductive material and over a surface thereof provided with an electrically non-conductive mask, leaving unmasked regions to form discrete and spaced apart metal regions which carry the abrasive material.

20. A method according to claim 16, wherein the porous layer consists of two or more layers of nonwoven fabric stretched on top of each other on the base.

21. A method according to claim 20, wherein after plating adjacent layers being adhered to each other by an adhesive having heat conductive properties.

22. A method according to claim 16, wherein the porous layer is coated with a heat conductive material.

23. A method according to claim 16, wherein after demounting from the base the porous layer, at a side thereof not containing abrasive material, is provided with a backing layer selected from a resin or a vulcanised rubber material.

24. A method according to claim 23, wherein said backing layer having heat conductive properties.

25. A method according to claim 23, wherein said side is coated with selected from an adhesive or a primer before the resin or rubber is applied.

* * * * *